US005755895A

United States Patent [19]

Tamehiro et al.

[11] Patent Number: 5,755,895

[45] Date of Patent: May 26, 1998

[54] HIGH STRENGTH LINE PIPE STEEL HAVING LOW YIELD RATIO AND EXCELLENT IN LOW TEMPERATURE TOUGHNESS

[75] Inventors: Hiroshi Tamehiro; Hitoshi Asahi; Takuya Hara, all of Futtsu; Yoshio Terada, Kimitsu, all of Japan

[73] Assignee: Nippon Steel Corporation, Tokyo, Japan

[21] Appl. No.: 718,567

[22] PCT Filed: Jan. 26, 1996

[86] PCT No.: PCT/JP96/00157

§ 371 Date: Oct. 1, 1996

§ 102(e) Date: Oct. 1, 1996

[87] PCT Pub. No.: WO96/23909

PCT Pub. Date: Aug. 8, 1996

[30] Foreign Application Priority Data

| | | | |
|---|---|---|---|
| Feb. 3, 1995 | [JP] | Japan | 7-017302 |
| Feb. 6, 1995 | [JP] | Japan | 7-018308 |
| Mar. 30, 1995 | [JP] | Japan | 7-072724 |
| Mar. 30, 1995 | [JP] | Japan | 7-072725 |
| Mar. 30, 1995 | [JP] | Japan | 7-072726 |
| Jul. 31, 1995 | [JP] | Japan | 7-195358 |

[51] Int. Cl.[6] ..... C22C 38/44; C22C 38/48

[52] U.S. Cl. ..... 148/336; 148/909; 420/119

[58] Field of Search ..... 148/336, 909; 420/119, 124

[56] References Cited

U.S. PATENT DOCUMENTS

| | | | |
|---|---|---|---|
| 4,222,771 | 9/1980 | Oda et al. | 420/67 |
| 4,464,209 | 8/1984 | Taira et al. | 420/89 |

FOREIGN PATENT DOCUMENTS

| | | | |
|---|---|---|---|
| 57-114638 | 7/1982 | Japan | 148/336 |
| 59-83722 | 5/1984 | Japan . | |
| 63-118012 | 5/1988 | Japan . | |
| 2125843 | 5/1990 | Japan . | |
| 2217417 | 8/1990 | Japan . | |
| 5195057 | 8/1993 | Japan . | |

*Primary Examiner*—Deborah Yee

*Attorney, Agent, or Firm*—Kenyon & Kenyon

[57] ABSTRACT

An ultra-high strength low yield ratio line pipe steel has an excellent HAZ toughness and field weldability and has a tensile strength of at least 950 MPa (exceeding X100 of the API standard). The steel is of a low carbon-high Mn-Ni-Mo-Nb-trace Ti type selectively containing B, Cu, Cr and V, whenever necessary. Its micro-structure comprises a martensite/bainite and ferrite soft/hard two-phase mixed structure having a ferrite fraction of 20 to 90%. This ferrite contains 50 to 1000 of worked ferrite, and the ferrite grain size is not greater than 5 Am. The production of an ultra-high strength low yield ratio line pipe steel (exceeding X100) excellent in low temperature toughness and field weldability becomes possible. As a result, the safety of a pipeline can be remarkably improved, and execution efficiency and transportation efficiency of the pipeline can be drastically improved.

12 Claims, No Drawings

HIGH STRENGTH LINE PIPE STEEL HAVING LOW YIELD RATIO AND EXCELLENT IN LOW TEMPERATURE TOUGHNESS

TECHNICAL FIELD

This invention relates to an ultra-high strength steel having a tensile strength (TS) of at least 950 MPa and excellent in low temperature toughness and weldability, which can be widely used as a weldable steel material for line pipes for transporting natural gases and crude oils, various pressure containers, industrial machinery, and so forth.

BACKGROUND ART

The strength of line pipes used for pipelines for the long distance transportation of crude oils and natural gases has become higher and higher in recent years due to ① an improvement in transportation efficiency by higher pressure and ② an improvement in on-site execution efficiency by the reduction of outer diameters and weights of the line pipes. Line pipes having X80 according to the American Petroleum Institute (API) standard (yield strength of at least 551 MPa and tensile strength of at least 620 MPa) have been put into practical use to this date, but the need for line pipes having a higher strength has become stronger and stronger.

Studies on the production methods of ultra-high strength line pipes have been made at present on the basis of the conventional production technologies of X80 line pipes (for example, NKK Engineering Report, No. 138 (1992), pp. 24–31 and The 7th Offshore Mechanics and Arctic Engineering (1988), Volume V, pp. 179–185), but the production of line pipes having X100 (yield strength of at least 689 MPa and tensile strength of at least 760 MPa) is believed to be the limit according to these technologies To achieve an ultra-high strength of pipe lines, there are a large number of problems yet to be solved, such as the balance between strength and low temperature toughness, the toughness of a welding heat affected zone (HAZ), field weldability, softening of joints, and so forth, and accelerated development of a revolutionary ultra-high strength line pipe (exceeding X100) which solves these problems has been earnestly desired.

DISCLOSURE OF THE INVENTION

In order to satisfy the requirements described above, the first object of the present invention is to provide a steel for a line pipe which has an excellent balance of a strength and a low temperature toughness, can be easily welded on field, and has an ultra-high strength and a low yield ratio of a tensile strength of at least 950 MPa (exceeding X100 by the API standard).

It is another object of the present invention to provide a steel for a high strength line pipe which is a low carbon high Mn (at least 1.7%) type steel containing Ni-Nb-Mo-trace Ti added compositely, and (② the micro-structure of which comprises a soft/hard mixed structure of fine ferrite (having a mean grain size of not greater than 5 μm and containing a predetermined amount of worked ferrite) and martensite/bainite.

The present invention specifies a P value (hardenability index) as a usable strength estimation formula of a steel which expresses the hardenability index for high strength line pipe steels and represents a value indicating higher transformability to a martensite or bainite structure when it takes a large value, and this P value can be given by the following general formula:

$$P=2.7C+0.4Si+Mn+0.8Cr+0.45(Ni+Cu)+(1+\beta)Mo+V-1+\beta$$

The β values is zero when B<3 ppm and is 1 when B≧3 ppm.

Further, the ferrite mean grain size is defined as a mean grain boundary distance of the ferrite when measured in the direction of the thickness of the steel material.

The present invention provides a high strength line pipe steel (1) which is a low carbon high Mn type steel containing Ni-Mo-Nb-trace Ti-trace B compositely added thereto, and a low carbon high Mn type steel containing Ni-Cu-Mo-Nb-trace Ti compositely added thereto, and (2) the micro-structure of which comprises a two-phase mixed structure of a fine ferrite (having a mean grain size of not greater than 5 μm and containing a predetermined amount of worked ferrite) and martensite/bainite.

Low carbon-high Mn-Nb-Mo steel has been known in the past as a line pipe steel having a fine acicular ferrite structure, but the upper limit of its tensile strength is 750 MPa at the highest. In this basic component system, a high strength line pipe steel having a hard/soft mixed fine structure comprising a fine ferrite containing worked ferrite and martensite/bainite does not at all exist. For, it has been believed until now that a tensile strength higher than 950 MPa could never be attained by the ferrite and martensite/bainite hard/soft mixed structure of the Nb-Mo steel, and that low temperature toughness and field weldability would not be sufficient, either.

However, the inventors of the present invention have discovered that even in Nb-Mo steel, an ultra-high strength and excellent low temperature toughness can be accomplished by strictly controlling the chemical components and the micro-structure. The characterizing features of the present invention reside in ① that the ultra-high strength and the excellent low temperature toughness can be obtained even without a tempering treatment and ② that the yield ratio is lower than that of the hardened/tempered steels, and pipe moldability and low temperature toughness are by far more excellent. (In the steel according to the present invention, even when the yield strength is low in the form of a steel plate, the yield strength increases by molding the plate into a steel pipe, and the intended yield strength can be obtained).

The present inventors have conducted intensive studies on the chemical compositions of steel materials and their micro-structures to obtain the ultra-high strength steels excellent in low temperature toughness and field weldability and having a tensile strength of at least 950 MPa, and have invented a high strength line pipe steel having a low yield ratio and excellent in low temperature toughness with the following technical gist.

(1) A high strength line pipe steel having a low yield ratio and excellent in low temperature toughness, containing, in terms of a percent by weight;

C: 0.05 to 0.10%,

Si: not greater than 0.6%-20,

Mn: 1.7 to 2.5%,

P: not greater than 0.015%,

S: not greater than 0.003%,

Ni: 0.1 to 1.0%,

Mo: 0.15 to 0.60%,

Nb: 0.01 to 0.10%,

Ti: 0.005 to 0.030%,

Al; not greater than 0.06%,

N: 0.001 to 0.006%, and the balance of Fe and unavoidable impurities;

having a P value defined by the following general formula within the range of 1.9 to 4.0; and having a micro-structure comprising martensite, bainite and ferrite, wherein the ferrite fraction is from 20 to 90%, the ferrite contains 50 to 100% of worked ferrite, and the ferrite mean grain size is not greater than 5 μm;

$$P=2.7C+0.45i+Mn+0.8Cr+0.45(Ni+Cu)+(1\beta)Mo+v-1+\beta,$$

with the proviso that β takes a value 0 when B<3 ppm, and a value 1 when B≧3 ppm.

(2) A high strength line pipe steel having a low yield ratio and excellent in low temperature toughness according to the item (1), which further contains:

B: 0.0003 to 0.0020%,

Cu: 0.1 to 1.2%,

Cr; 0.1 to 0.6%, and

V: 0.01 to 0.10%.

(3) A high strength line pipe steel having a low yield ratio and excellent in low temperature toughness according to the items (1) and (2), which further contains:

Ca: 0.001 to 0.006%,

REM: 0.001 to 0.02%, and

Mg: 0.001 to 0.006%.

(4) A high strength line pipe steel having a low yield ratio and excellent in low temperature toughness, containing, in terms of a percent by weight:

C: 0.05 to 0.10%,

Si; not greater than 0.6%,

Mn: 1.7 to 2.2%,

P: not greater than 0.015%,

S: not greater than 0.003%,

Ni: 0.1 to 1.0%,

Mo: 0.15 to 0.50%,

Nb: 0.01 to 0.10%,

Ti: 0.005 to 0.030%,

Al: not greater than 0.06%,

B; 0.0003 to 0.0020%,

N: 0.001 to 0.006%, and the balance of Fe and unavoidable impurities:

having a P value defined by the following general formula within the range of 2.5 to 4.0; and having a micro-structure comprising martensite, bainite and ferrite, wherein a ferrite fraction is from 20 to 90%, the ferrite contains 50 to 100% of worked ferrite, and a ferrite mean grain size is not greater than 5 μm:

P value=2.7C+0.4Si+Mn+0.45Ni+2Mo.

(5) A high strength line pipe having a low yield ratio and excellent in low temperature toughness according to the item (4), which further contains:

V: 0.01 to 0.10%,

Cr: 0.1 to 0.6%, and

Cu: 0.1 to 1.0%.

(6) A high strength line pipe steel having a low yield ratio and excellent in low temperature toughness, containing, in terms of a percent by weight:

C: 0.05 to 0.10%,

Si: not greater than 0.6%,

Mn: 1.7 to 2.5%,

P: not greater than 0.015%,

S: not greater than 0.003%,

Ni: 0.1 to 1.0%,

Mo: 0.35 to 0.50%,

Nb: 0.01 to 0.10%,

Ti: 0.005 to 0.030%,

Al: not greater than 0.06%,

Cu: 0.8 to 1.2%,

N: 0.001 to 0.006%, and the balance of Fe and unavoidable impurities;

having a P value defined by the following general formula within the range of 2.5 to 3.5; and having a micro-structure comprising martensite, bainite and ferrite, wherein a ferrite fraction is 20 to 90%, the ferrite contains 50 to 100% of worked ferrite, and a ferrite mean grain size of not greater than 5 μm:

P value=2.7C+0.4Si+Mn4 0.8Cr+0.45(Ni+Cu) +Mo+v−1.

(7) A high strength line pipe steel having a low yield ratio and excellent in low temperature toughness according to the item (6), which further contains:

Cr: 0.1 to 0.6%, and

V: 0.01 to 0.10%.

(8) A high strength line pipe steel having a low yield ratio and excellent in low temperature toughness, according to the items (4) through (7), which further contains:

Ca: 0.001 to 0.006%,

REM: 0.001 to 0.02%, and

Mg: 0.001 to 0.0061.

BEST MODE FOR CARRYING OUT THE INVENTION

Hereinafter, the present invention will be described in detail..

First of all, the micro-structure of the steel of the present invention will be explained.

To achieve an ultra-high tensile strength of at least 950 MPa, the micro-structure of the steel material must comprise a predetermined amount of martensite-bainite and to this end, the ferrite fraction must be 20 to 90% (or the martensite/bainite fraction must be 10 to 80%). When the ferrite fraction is greater than 90%, the martensite/bainite fraction becomes so small that the intended strength cannot be achieved. (The ferrite fraction depends also on the C content, and it is notably difficult to attain a ferrite fraction of at least 90% when the C content exceeds 0.05%).

In the steel according to the present invention, the most desirable ferrite fraction is 30 to 80% from the viewpoints of the strength and the low temperature toughness. However, ferrite is originally soft. Therefore, even when the ferrite fraction is 20 to 90%, the intended strength (particularly, the yield strength) and the low temperature toughness cannot be accomplished if the proportion of worked ferrite is too small. Therefore, the proportion of the worked ferrite is set to 50 to 100%. Working (rolling) of the ferrite improves its yield strength by dislocation strengthening and sub-grain strengthening, and at the same time, it is extremely effective for improving the Charpy transition temperature as will be later described.

Even limiting the micro-structure as described above is not yet sufficient to accomplish an excellent low temperature toughness. To attain this object, it is necessary to utilize separation by introducing the worked ferrite, and to fine the mean grain size of the ferrite to not greater than 5 m. It has been clarified that in the ultra-high strength steel, too, the separation occurs on the fracture of the Chaxpy impact test, etc., by the introduction of the worked ferrite (texture), and that the fracture transition temperature is drastically lowered. (The separation is a laminar peel phenomenon occurring on the fracture of the Charpy impact test, etc., and is believed to lower the triaxial stress at the distal end of brittle cracks and to improve brittle crack propagation step characteristics).

It has also been found that when the ferrite mean grain size is set to not greater than 5 μm, the martensite/bainite structure other than the ferrite is simultaneously fined, and a remarkable improvement of the transition temperature and the increase of the yield strength can be obtained.

As described above, the present invention has succeeded in the drastic improvement of the balance of the strength and the low temperature toughness of the hard/soft mixed structure of the ferrite of the martensite/bainite structure in Nb-Mo steel, the low temperature toughness of which had been believed inferior in the past.

However, even if the micro-structure of the steel is strictly controlled as described above, the steel material having the intended characteristics cannot be obtained, To accomplish this object, the chemical compositions must be limited simultaneously with the micro-structure, Hereinafter, the reasons for limitation of the chemical compositions will be explained.

The C content is limited to 0.05 to 0.10%. Carbon is an extremely effective element for improving the strength of steel. In order to obtain the intended strength in the ferrite and martensite/bainite hard/soft mixed structure, at least 0.05% of C is necessary. This is also the minimum necessary amount for securing the effect of precipitation hardening by the addition of Nb and V, the refining effect of the crystal grains and the strength of the weld portion. If the C content is too high, however, the low temperature toughness of both the base metal and the HAZ and field weldability are remarkably deteriorated. Therefore, the upper limit is set to 0.10%.

Silicon (Si) is added for deoxidation and for improving the strength. If its content is too high, however, the HAZ toughness and field weldability are remarkably deteriorated. Therefore, its upper limit is set to 0.6%. Deoxidation of the steel can be sufficiently accomplished by Ti or Al and Si need not always be added.

Manganese (Mn) is an essential element for converting the micro-structure of the steel of the present invention to the ferrite and martensite/bainite hard/soft mixed structure and securing an excellent balance between strength and low temperature toughness, and its lower limit is 1.7%. If the Mn content is too high, however, hardenability of the steel increases, so that not only the HAZ toughness and field weldability are deteriorated but center segregation of the continuous cast steel slab is promoted and the low temperature toughness of the base metal are deteriorated. Therefore, its upper limit is set to 2.5%. The preferred Mn content is from 1.9 to 2.1%.

The object of addition of nickel (Ni) is to improve the strength of the low carbon steel of the present invention without deteriorating the low temperature toughness and field weldability. In comparison with the addition of Mn, Cr and Mo, the addition of Ni forms less of the hardened structure detrimental to the low temperature toughness in the rolled structure (particularly, in the center segregation band of the slab), and the addition of trace Ni is found effective for improving the HAZ toughness, too. From the aspect of the HAZ toughness, a particularly effective amount of addition of Ni is greater than 0.3%. However, if the addition amount is too high not only economy but also the HAZ toughness and field weldability are deteriorated. Therefore, the upper limit is set to 1.0%. The addition of Ni is also effective for preventing Cu cracks at the time of hot rolling and continuous casting. In this case, Ni must be added in an amount of at least ⅓ of the Cu content.

Molybdenum (Mo) is added in order to improve hardenability of the steel and to obtain the intended hard/soft mixed structure. When co-present with Nb, Mo strongly suppresses the recrystallization of austenite during controlled rolling and refines the austenite structure. To obtain such an effect, at least 0.15% of Mo must be added. However, the addition of Mo in an excessive amount deteriorates the HAZ toughness and field weldability, and its upper limit is set to 0.6%.

Further, the steel according to the present invention contains 0.01 to 0.10% of Nb and 0.005 to 0.030% of Ti as the essential elements.

When co-present with Mo, niobium (nb) suppresses recrystallization of austenite during controlled rolling and refines the crystal grains. It also makes great contributions to the improvement in precipitation hardening and hardenability, and improves the toughness of the steel. When the addition amount of Nb is too great, however, it exerts adverse influences on the HAZ toughness and site weldability. Therefore, its upper limit is set to 0.10%.

On the other hand, the addition of titanium (Ti) which forms a fine TiN, restricts coarsening of the austenite grains at the time of slab re-heating and of the HAZ of welding, refines the micro-structure, and improves the low temperature toughness of the base metal and the HAZ When the AX content is small (for example, not greater than 0.005%), Ti forms an oxide, functions as an intra-grain ferrite formation nucleus and refines the HAZ structure. To obtain such effects of the Ti addition, at least 0.005% of Ti must be added. When the Ti content is too high, however, coarsening of TiN and precipitation hardening due to TiC occur and the low temperature toughness is deteriorated. Therefore, its upper limit is set to 0.03%.

Aluminum (Al) is ordinarily contained as a deoxidation agent in steel, and has the effect of refining the structure. However, if the Al content exceeds 0.06%, alumina type non-metallic inclusions increase and lower the cleanness of the steel. Therefore, the upper limit is set to 0.06%. Deoxidation can be accomplished by Ti or Si, and AC need not be always added.

Nitrogen (N) forms TiN, restricts coarsening of the austenite grains during re-heating of the slab and the austenite grains of the HAZ, and improves the low temperature toughness of both the base metal and the HAZ. The minimum necessary amount in this instance is 0.001%. When the N content is too high, however, N will result in surface defects of the slab and in deterioration of the HAZ toughness due to the solid solution N. Therefore, its upper limit must be limited to 0.006%.

Further, the present invention limits the P and 5 contents as impurities elements to not greater than 0.015% and not grater than 0.003%, respectively. The main object of the addition of these elements is to further improve the low temperature toughness of both the base metal and the HAZ. The reduction of the P content lowers center segregation of the continuous cast slab, prevents grain boundary destruction and improves the low temperature toughness. The reduction of the S content is necessary so as to reduce MnS, which is elongated in controlled rolling, and to improve the ductility and the toughness.

Furthermore, at least one of the following elements is selectively added, whenever necessary:

B: 0.0003 to 0.0020%,

Cu: 0.1 to 1.0%,

Cr: 0.1 to 0.8%, and

V: 0.01 to 0.10%.

Next, the object of the addition of B, Cu, Cr, V, Ca, Mg and Y will be explained.

Boron (B) restricts the formation of coarse ferrite from the grain boundary during rolling and contributes to the formation of fine ferrite from inside the grains. Further, B restricts the formation of the grain boundary ferrite in the HAZ and improves the HAZ toughness in welding methods having a large heat input such as SAW used for seam welding of weldable steel pipes. If the amount of addition of B is not greater than 0.0003%, no effect can be obtained and if it exceeds 0.0020%, B compounds will precipitate and lead to reduced low temperature toughness. Therefore, the amount of addition is set to the range of 0.0003 to 0.0020%.

Copper (Cu) drastically improves the strength in the ferrite and martensite/bainite two-phase mixed structure by hardening and precipitation strengthening the martensite/bainite phase. It is also effective for improving the corrosion resistance and hydrogen induced crack resistance. If the Cu content is less than 0.1%, these effects cannot be obtained. Therefore, the lower limit is set to 0.1%. When added in an excessive amount, Cu leads to induced toughness of both the base metal and the HAZ due to precipitation hardening, and Cu cracks occur during hot working, too. Therefore, its upper limit is set to 1.2%.

Chromium (Cr) increases the strength of the weld portion. If the amount of addition is too high, however, the HAZ toughness as well as field weldability are remarkably deteriorated. Therefore, the upper limit of the Cr content is 0.8%. If the amount of addition is less than 0.1%, these effects cannot be obtained. Therefore, the lower limit is set to 0.1%.

Vanadium (V) has substantially the same effect as Nb, but its effect is weaker than that of Nb However, the effect of the addition of V in ultra-high strength steels is great, and the composite addition of Nb and V makes the excellent features of the present invention all the more remarkable. V undergoes strain-induced precipitation during working (hot rolling) of ferrite, and remarkably strengthens ferrite. If the amount of addition is less than 0.01%, such an effect cannot be obtained. Therefore, the lower limit is set to 0.01%. The upper limit of up to 0.10% is permissible from the aspects of the HAZ toughness and field weldability, and a particularly preferred range is 0.03 to 0.08%.

Furthermore, at least one of the following components,

Ca: 0.001 to 0.006%, and

REM: 0.001 to 0.02%, or at least one of the following components,

Mg: 0.001 to 0.006%, and

Y: 0.001 to 0.010%, may be added, whenever necessary.

Next, the reasons why Ca, REM, Mg and Y are added will be explained.

Ca and REM control the formation of a sulfide (MnS) and improve the low temperature toughness (the increase in absorption energy in a Charpy test, etc). However, no practical effect can be obtained if the Ca or REM content is not greater than 0.001%, and if the Ca content exceeds 0.006% or the REM content exceeds 0.02%, large quantities of CaO-CaS or REM-CaS are formed and result in large clusters and large inclusions. They not only deteriorate the cleanness of the steel but adversely affect field weldability. Therefore, the upper limit of the addition amount of Ca or REM is set to 0.006% or 0.02%, respectively. Furthermore, in ultra-high strength line pipes, it is particularly effective to reduce the S and O contents to 0.001% and 0.002%, respectively, and to set ESSP=(Ca)|1−124(O))/1.255 to 0.5 5 ESSP≦10.0. The term "ESSP" is the abbreviation of "Effective Sulfide State Control Parameter".

Each of magnesium (Mg) and yttrium (Y) forms a fine oxide, restricts the growth of the grains when the steel is rolled and re-heated, and refines the structure after hot rolling. Further, they suppress the grain growth of the welding heat affected zone and improve the low temperature toughness of the HAZ. It their amount of addition is too small, their effect cannot be obtained, and if their amount of addition is too high, on the other hand, they become coarse oxides and deteriorate the low temperature toughness. Therefore, the amounts of addition are set to Mg: 0.001 to 0.006% and Y: 0.001 to 0.010%. When Mg and Y are added, the AQ content is preferably set to not greater than 0.005% from the aspects of fine dispersion and the yield.

Besides the limitation of the individual addition elements described above, the present invention preferably limits $$P=2.7C+0.45i+Mn+0.8Cr+0.45(Ni+Cu)+(1+\beta)Mo+V-1$$

to 1.9≦P≦4.0 when the steel contains the Mo support, to 2.5≦P≦4.0 when B is further added, and to 2.5≦P≦3.5 when Cu is further added to the steel. This is to accomplish the intended balance between the strength and the low temperature toughness without deteriorating the HAZ toughness and field weldability. The lower limit of the P value is set to 1.9 so as to obtain a strength of at least 950 MPa and an excellent low temperature toughness. The upper limit of the P value is set to 4.0 so as to maintain the excellent HAZ toughness and field weldability.

In the present invention, a low C-high Mn-Nb-V-Mo-Ti type steel, a Ni-Mo-Nb-trace Ti-trace B type steel and a Ni-Cu-Mo-Nn-trace Ti type steel are heated to the low temperature zone of austenite, are then rolled under strict control in the austenite/ferrite two-phase zone, and are cooled with air or are rapidly cooled to obtain a fine worked ferrite plus martensite/bainite mixed structure,.-thereby simultaneously achieving ultra-high strength and excellent low temperature toughness and field weldability and softening the weld portion by the worked ferrite plus martensite/bainite mixed structure. Next, the reasons for limitation of the production conditions will be explained.

In the present invention, the slab is first re-heated to a temperature within the range of 950° to 1,300° C. and is then hot rolled so that the cumulative rolling reduction ratio is at least 50% at a temperature not higher than 950° C., the cumulative rolling reduction ratio is 10 to 70%, preferably 15 to 50%, in the ferrite-austenite two-phase zone of an $Ar_3$ point to an $Ar_1$ point, and a hot rolling finish temperature is 650° to 800° C. Thereafter, the hot rolled plate is cooled with air, or is cooled at a cooling rate of at least 10° C./sec to an arbitrary temperature not higher than 500° C.

This process is directed to keep small the initial austenite grains at the time of re-heating of the slab and to refine the rolled structure. For, the smaller the initial austenite grains, the more likely becomes the two-phase structure of fine ferrite-martensite to occur. The temperature of 1,300° C. is the upper limit temperature at which the austenite grains at the time of re-heating do not become coarse. If the heating temperature is too low, on the other hand, the alloy elements do not solve sufficiently, and a predetermined material cannot be obtained. Because heating for a long time is necessary so as to uniformly heat the slab and deformation resistance at the time of hot rolling becomes great, the energy cost increases undesirably. Therefore, the lower limit of the re-heating temperature is set to 950° C.

The re-heated slab must be rolled so that the cumulative rolling reduction quantity at a temperature not higher than 950° C. is at least 50%, the cumulative reduction quantity of the ferrite-austenite two-phase zone at the $Ar_3$ to $Ar_1$ point is 10 to 70%; preferably 15 to 50%; and the hot rolling finish temperature is 650° to 800° C. The reason why the cumulative rolling reduction quantity below 950° C. is limited to at least 50% is to increase rolling in the austenite un-recrystallization zone, to refine the austenite structure before transformation and to convert the structure after transformation to the ferrite-martensite/bainite mixed structure. The ultra-high strength line pipe having a tensile strength of at least 950 MPa requires a higher toughness than ever from the aspect of safety. Therefore, its cumulative reduction quantity must be at least 50%. (The cumulative rolling reduction quantity is preferably as high as possible, and has no upper limit).

In the present invention, further, the cumulative rolling reduction quantity of the ferrite-austenite two-phase zone must be 10 to 70% and the hot rolling finish temperature must be 650° to 800° C., This is to further refine the austenite structure, which is refined in the austenite un-recrystallization zone, to work and strengthen ferrite, and to make it easy for the separation to more easily occur at the time of the impact test.

When the cumulative rolling reduction quantity of the two-phase zone is lower than 50%, the occurrence of the separation is not sufficient, and the improvement in the propagation stop characteristics of brittle cracks cannot be obtained. Even when the cumulative rolling reduction quantity is suitable, the excellent low temperature toughness cannot be accomplished if the rolling temperature is not suitable. If the hot rolling finish temperature is lower than 650° C., brittleness of ferrite due to machining becomes remarkable. Therefore, the lower limit of the hot rolling finish temperature is set to 650° C. If the hot rolling finish temperature exceeds 800° C., however, fining of the austenite structure and the occurrence of the separation are not sufficient. Therefore, the upper limit of the hot rolling finish temperature is limited to 800° C.

After hot rolling is completed, the steel plate is either cooled with air, or is cooled to an arbitrary temperature lower then 500° C. at a cooling rate of at least 10° C./sec. In the steel of the present invention, the ferrite and martensite/bainite mixed structure can be obtained even when cooling with air is carried out after rolling, but in order to further increase the strength, the steel plate may be cooled down to an arbitrary temperature lower than 500° C. at a cooling rate of at least 10° C./sec. Cooling at the cooling rate of at least 10° C./sec is to accelerate transformation and to refine the structure by the formation of martensite, etc. If the cooling rate is lower than 10° C./sec or the water cooling stop temperature is higher than 500° C., the improvement of the balance of the strength and the low temperature toughness by transformation strengthening cannot be sufficiently expected.

It is one of the characterizing features of the steel of the present invention that it need not be tempered, but tempering may be carried out so as to conduct residual stress cooling.

EMBODIMENT

Next, Examples of the present invention will be described.

EXAMPLE 1

Slabs having various chemical compositions were produced by melting on a laboratory scale (ingot: 50 kg, 120 mm-thick) or by a converter continuous-casting method (240 mm-thick). These slabs were hot rolled to steel plates having a thickness of 15 to 32 mm under various conditions, and various mechanical properties and micro-structures were examined (tempering was applied to some of the steel plates).

The mechanical properties of the steel plates (yield strength: YS, tensile strength: TS, absorption energy at −40° C. in Charpy impact test; vE-40, 50% fracture transition temperature: vTrs) were examined in a direction at right angles to the rolling direction.

The HAZ toughness (absorption energy at −20° C. in the Charpy test: $vE_{31\ 20}$) was evaluated by the simulated HAZ specimens (maximum heating temperature: 1,400° C., cooling time of 800° to 500° C. [$\Delta t_{800\text{-}500}$]: 25 sec).

Field weldability was evaluated by the lowest pre-heating temperature necessary for preventing low temperature cracking of the HAZ in a Y-slit weld crack test (JIS G3158) (welding method: gas metal arc welding, welding rod: tensile strength of 100 MPa, heat input: 0.5 kJ/mm, hydrogen quantity of weld metal: 3 cc/100 g metal).

The Examples are tabulated in Tables 1 and 2. The steel sheets produced in accordance with the method of the present invention had an excellent balance between the strength and the low temperature toughness, the HAZ toughness and field weldability. In contrast, the comparative steels are remarkably inferior in any of their properties because their chemical compositions or microstructures were not suitable.

Since Steel No. 9 had an excessive C content, the Charpy absorption energy of both the base metal and the HAZ was low, and the pre-heating temperature at the time of welding was high, too. Since Nb was not added in Steel No. 13, the strength was not sufficient, the ferrite grain size was large, and the toughness of the base metal was inferior. Since the S content was too high in Steel No. 14, the low temperature toughness of both the base metal and the HAZ was inferior. Since the ferrite grain size was too large in Steel No. 18, the low temperature toughness was remarkably inferior. Since the ferrite fraction and the worked ferrite fraction were small in Steel No. 19, the yield strength was low and the Charpy transition temperature was inferior.

TABLE 1

| Section | Steel | Chemical Compositions (wt %, *ppm) C | Si | Mn | P* | S* | Ni | Mo | Nb | Ti | Al | N* | others | Steel Plate P Value | Thickness (mm) |
|---|---|---|---|---|---|---|---|---|---|---|---|---|---|---|---|
| Steel of This Invention | 1 | 0.058 | 0.26 | 2.37 | 100 | 16 | 0.40 | 0.43 | 0.041 | 0.009 | 0.027 | 23 | | 2.24 | 15 |
| | 2 | 0.093 | 0.32 | 1.89 | 60 | 8 | 0.48 | 0.57 | 0.024 | 0.012 | 0.018 | 40 | | 1.96 | 20 |
| | 3 | 0.064 | 0.18 | 2.15 | 70 | 3 | 0.24 | 0.38 | 0.017 | 0.021 | 0.024 | 56 | Cr:0.34 | 2.16 | 20 |
| | 4 | 0.070 | 0.27 | 2.10 | 50 | 7 | 0.34 | 0.51 | 0.038 | 0.015 | 0.027 | 38 | Cu:0.39 | 2.24 | 20 |
| | 5 | 0.073 | 0.23 | 2.24 | 120 | 18 | 0.18 | 0.46 | 0.041 | 0.016 | 0.034 | 27 | V:0.05, Mg:0.003 | 2.12 | 20 |
| | 6 | 0.067 | 0.02 | 2.13 | 80 | 6 | 0.36 | 0.47 | 0.032 | 0.015 | 0.019 | 37 | V:0.06, Cu:0.41 | 2.20 | 20 |
| | 7 | 0.075 | 0.27 | 2.01 | 60 | 10 | 0.35 | 0.45 | 0.038 | 0.016 | 0.002 | 33 | V:0.07, Cu:0.37 Cr:0.35 | 2.44 | 22 |
| | 8 | 0.072 | 0.12 | 2.03 | 70 | 5 | 0.52 | 0.43 | 0.038 | 0.017 | 0.028 | 35 | V:0.07, Cu:0.53 Ca:0.0021 | 2.24 | 32 |
| Comparative Steels | 9 | 0.117 | 0.26 | 2.01 | 80 | 15 | 0.37 | 0.38 | 0.032 | 0.015 | 0.021 | 29 | | 1.98 | 15 |
| | 13 | 0.072 | 0.27 | 2.08 | 70 | 5 | 0.37 | 0.46 | 0.004 | 0.018 | 0.025 | 29 | | 2.01 | 20 |
| | 14 | 0.080 | 0.38 | 2.12 | 80 | 53 | 0.41 | 0.47 | 0.035 | 0.015 | 0.031 | 35 | | 2.14 | 20 |
| | 18 | 0.075 | 0.24 | 2.02 | 40 | 6 | 0.38 | 0.48 | 0.035 | 0.012 | 0.022 | 32 | V:0.05 | 2.02 | 20 |
| | 19 | 0.075 | 0.24 | 2.02 | 40 | 6 | 0.38 | 0.48 | 0.035 | 0.012 | 0.022 | 32 | V:0.05 | 2.02 | 20 |

TABLE 2

| Section | Steel | Micro-Structure Ferrite Fraction (%) | Proportion of Worked Ferrite (%) | Mean Ferrite Grain Size (μm) | Mechanical Properties YS (N/mm²) | TS | vE$_{-40}$ (J) | vTrs (°C.) | HAZ Toughness vE$_{-20}$ (J) | Field Weldability Lowest Preheating Temperature (°C.) |
|---|---|---|---|---|---|---|---|---|---|---|
| Steel of This Invention | 1 | 27 | 86 | 3.2 | 762 | 1031 | 206 | −140 | 213 | Preheating Not Necessary |
| | 2 | 42 | 58 | 4.5 | 881 | 1012 | 210 | −120 | 187 | Preheating Not Necessary |
| | 3 | 51 | 65 | 3.7 | 746 | 991 | 204 | −120 | 159 | Preheating Not Necessary |
| | 4 | 28 | 96 | 4.6 | 758 | 1006 | 289 | −140 | 202 | Preheating Not Necessary |
| | 5 | 31 | 83 | 3.2 | 753 | 1021 | 226 | −120 | 157 | Preheating Not Necessary |
| | 6 | 87 | 100 | 2.1 | 738 | 984 | 259 | −160 | 320 | Preheating Not Necessary |
| | 7 | 36 | 78 | 3.0 | 875 | 991 | 251 | −135 | 307 | Preheating Not Necessary |
| | 8 | 83 | 100 | 2.3 | 721 | 989 | 231 | −150 | 243 | Preheating Not Necessary |
| Comparative Steel | 9 | 28 | 87 | 3.5 | 898 | 1034 | 127 | −85 | 56 | 100 |
| | 13 | 32 | 78 | 6.9 | 678 | 933 | 15 | −35 | 256 | Preheating Not Necessary |
| | 14 | 30 | 86 | 3.7 | 720 | 1004 | 31 | −60 | 78 | Preheating Not Necessary |
| | 18 | 28 | 67 | 7.8 | 725 | 1039 | 14 | −30 | 281 | Preheating Not Necessary |
| | 19 | 8 | 0 | 4.2 | 683 | 1017 | 221 | −75 | 276 | Preheating Not Necessary |

EXAMPLE 2

Slabs having various chemical compositions were produced by melting on a laboratory scale (ingot: 100 kg, 150 mm-thick) or by a converter continuous-casting method (240 mm-thick). These slabs were hot rolled to steel plates having a thickness of 16 to 24 mm under various conditions, and various mechanical properties and micro-structures were examined (yield strength: YS, tensile strength: TS, absorption energy at −40° C. in Charpy test: vE-40, 50% fracture transition temperature: vTrs) in a direction at right angles to the rolling direction. A separation index $S_1$ on the Charpy fracture at −100° C. (the value obtained by dividing the total length of the separation on the fracture by the area 8×10 (mm²) of the fracture; the greater this value, the more excellent the crack propagation stop characteristics) was measured as the crack propagation stopping characteristics. The HAZ toughness (absorption energy at −20° C. in the Charpy test: vE-$_{20}$) was evaluated by the simulated HAZ specimens (maximum heating temperature: 1,400° C., cooling time from 800° to 500° C. [$\Delta t_{800-500}$]: 25 sec). Field weldability was evaluated by the lowest pre-heating temperature necessary for preventing low temperature cracking of the HAZ in the Y-slit weld crack test (JIS G3158) (welding method; gas metal arc welding, welding rod: tensile strength 100 MPa, heat input: 0.3 kJ/mm, hydrogen quantity of weld metal: 3 cc/100 g metal).

Tables 3 and 4 tabulate the samples and the measurement results of each characteristic.

The steel plates produced in accordance with the method of the present invention exhibited an excellent balance of the strength and the low temperature toughness, and excellent HAZ toughness and field weldability. In contrast, since the chemical compositions or the micro-structures were not suitable in the comparative steels, any of their characteristics were remarkably inferior.

The steel compositions of Comparative Steel 1* in Table 4 were the same as steel 1 of this invention, but the micro-structure was different.

EXAMPLE 3

Slabs having various chemical compositions were produced by melting on a laboratory scale (ingot of 50 kg and 100 mm-thick) or by a converter continuous-casting method (240 mm-thick). These slabs were hot rolled to steel plates

TABLE 3

Chemical Compositions (wt %)

| | Steel | C | Si | Mn | P | S | Ni | Mo | Nb | Al | Ti | B | N | Others | P Value |
|---|---|---|---|---|---|---|---|---|---|---|---|---|---|---|---|
| Steel of This Invention | 1 | 0.07 | 0.24 | 2.15 | 0.006 | 0.001 | 0.70 | 0.42 | 0.02 | 0.018 | 0.016 | 0.0009 | 0.0027 | | 3.55 |
| | 2 | 0.06 | 0.05 | 1.99 | 0.007 | 0.001 | 0.35 | 0.33 | 0.03 | 0.003 | 0.013 | 0.0011 | 0.0033 | V:0.052, Cu:0.42 | 3.23 |
| | 3 | 0.06 | 0.30 | 1.80 | 0.012 | 0.002 | 0.43 | 0.24 | 0.04 | 0.034 | 0.022 | 0.0014 | 0.0031 | Cu:0.80, Cr:0.4 | 3.44 |
| | 4 | 0.08 | 0.24 | 1.97 | 0.007 | 0.001 | 0.61 | 0.39 | 0.01 | 0.002 | 0.018 | 0.0007 | 0.0022 | V:0.032; Mg:0.003 | 3.37 |
| | 5 | 0.06 | 0.18 | 2.12 | 0.013 | 0.002 | 0.32 | 0.19 | 0.07 | 0.016 | 0.015 | 0.0008 | 0.0035 | REM:0.006 | 2.88 |
| | 6 | 0.07 | 0.37 | 1.78 | 0.005 | 0.001 | 0.51 | 0.31 | 0.02 | 0.001 | 0.008 | 0.0012 | 0.0018 | Cr:0.3, Y:0.007 | 3.21 |
| | 7 | 0.06 | 0.20 | 1.87 | 0.006 | 0.001 | 0.55 | 0.37 | 0.04 | 0.002 | 0.025 | 0.0006 | 0.0025 | | 3.10 |
| | 8 | 0.08 | 0.15 | 1.90 | 0.010 | 0.002 | 0.42 | 0.25 | 0.01 | 0.011 | 0.010 | 0.0008 | 0.0017 | V:0.061 | 2.93 |
| Comparative Steel | 10 | 0.06 | 0.25 | 1.96 | 0.009 | 0.001 | 0.37 | 0.75 | 0.02 | 0.030 | 0.015 | 0.0009 | 0.0027 | | 3.89 |
| | 11 | 0.06 | 0.18 | 1.60 | 0.010 | 0.002 | 0.38 | 0.22 | 0.04 | 0.043 | 0.020 | 0.0011 | 0.0035 | Cu:0.4 | 2.63 |
| | 12 | 0.08 | 0.31 | 2.53 | 0.008 | 0.001 | 0.86 | 0.32 | 0.04 | 0.035 | 0.024 | 0.0013 | 0.0034 | | 3.90 |

TABLE 4

| | | Plate | Micro-Structure | | | Mechanical Properties | | | | | HAZ | Field Weldable |
|---|---|---|---|---|---|---|---|---|---|---|---|---|
| Section | Steel | Thickness (mm) | Ferrite Fraction (%) | Proportion of Worked Ferrite (%) | Mean Ferrite Grain Size (μm) | YS (MPa) | TS (MPa) | $vE_{-40}$ (J) | vTrs (°C.) | Separation Index $S_1$ | Toughness $vE_{-20}$ (J) | Lowest Preheating Temp. (°C.) |
| Steel of This Invention | 1 | 24 | 32 | 69 | 3.8 | 790 | 1112 | 203 | −115 | 53 | 172 | Preheating Not Necessary |
| | 1 | 20 | 51 | 86 | 3.4 | 758 | 1098 | 220 | −110 | 59 | 172 | Preheating Not Necessary |
| | 2 | 20 | 43 | 70 | 3.1 | 771 | 1071 | 254 | −110 | 47 | 165 | Preheating Not Necessary |
| | 3 | 20 | 29 | 66 | 4.2 | 760 | 1085 | 248 | −105 | 40 | 156 | Preheating Not Necessary |
| | 4 | 20 | 43 | 75 | 3.6 | 727 | 1069 | 263 | −120 | 43 | 199 | Preheating Not Necessary |
| | 5 | 16 | 33 | 67 | 3.3 | 696 | 995 | 218 | −195 | 41 | 134 | Preheating Not Necessary |
| | 6 | 20 | 67 | 81 | 2.8 | 716 | 1053 | 225 | −100 | 50 | 188 | Preheating Not Necessary |
| | 7 | 20 | 23 | 56 | 3.0 | 731 | 1030 | 222 | −105 | 45 | 143 | Preheating Not Necessary |
| | 8 | 20 | 24 | 66 | 4.0 | 712 | 1047 | 237 | −85 | 38 | 128 | Preheating Not Necessary |
| | 8 | 20 | 82 | 96 | 2.3 | 718 | 1041 | 250 | −90 | 48 | 128 | Preheating Not Necessary |
| Comparative Steels | 10 | 20 | 38 | 75 | 3.6 | 830 | 1154 | 201 | −85 | 48 | 73 | 100 |
| | 11 | 20 | 58 | 71 | 3.9 | 669 | 931 | 199 | −90 | 42 | 88 | Preheating Not Necessary |
| | 12 | 20 | 75 | 90 | 3.1 | 803 | 1143 | 185 | −75 | 37 | 56 | 100 |
| | 1* | 20 | 67 | 59 | 7.7 | 750 | 1071 | 212 | −70 | 29 | 172 | Preheating Not Necessary |
| | 1* | 20 | 14 | 95 | 3.9 | 732 | 1060 | 170 | −70 | 5 | 172 | Preheating Not Necessary |
| | 1* | 20 | 42 | 30 | 4.1 | 637 | 938 | 182 | −65 | 9 | 172 | Preheating Not Necessary |

having a thickness of 15 to 25 mm under various conditions, and were tempered, in some cases, to examine their various properties and micro-structures. Various mechanical properties of these steel plates (yield strength: YS, tensile strength: TS, absorption energy at −40° C. in the Charpy test: $vE_{-40}$, 50% fracture transition temperature: vTrs) were examined in the direction at right angles to the rolling direction.

The HAZ toughness (absorption energy at −400° C. in the Charpy test: video) was evaluated by the simulated HAZ specimens (maximum heating temperature: 40° C., cooling time from 800° to 500° C. [$\Delta t_{800-500}$]: 25 sec).

Field weldability was evaluated by the lowest pre-heating temperature necessary for preventing low temperature cracking of the HAZ in the Y-slit weld crack test (JIS G3158) (welding method: gas metal arc welding, welding rod: tensile strength 100 MPa, heat input: 0.3 kJ/mm, hydrogen amount of the weld metal: 3 cc/100 g metal).

These Examples are tabulated in Tables 5 and 6. The steel plates produced in accordance with the method of the present invention exhibited an excellent balance of the strength and the low temperature toughness, and excellent HAZ toughness and field weldability. In contrast, it was obvious that the comparative steels were remarkably inferior in any of their characteristics because their chemical compositions or micro-structures were not proper.

TABLE 5

Chemical Compositions (wt %)

| Steel | C | Si | Mn | P | S | Ni | Cu | Mo | Nb | Ti | Al | N | Others | P Value |
|---|---|---|---|---|---|---|---|---|---|---|---|---|---|---|
| 1 | 0.07 | 0.30 | 2.02 | 0.008 | 0.001 | 0.50 | 1.00 | 0.46 | 0.042 | 0.012 | 0.029 | 0.0028 | | 2.46 |
| 2 | 0.06 | 0.08 | 1.98 | 0.006 | 0.002 | 0.60 | 1.12 | 0.43 | 0.031 | 0.015 | 0.036 | 0.0035 | V:0.06 | 2.44 |
| 3 | 0.08 | 0.12 | 2.12 | 0.012 | 0.001 | 0.80 | 0.83 | 0.40 | 0.028 | 0.014 | 0.048 | 0.0042 | | 2.52 |
| 4 | 0.07 | 0.25 | 1.83 | 0.004 | 0.001 | 0.60 | 1.01 | 0.38 | 0.025 | 0.018 | 0.008 | 0.0026 | Cr:0.55 | 2.66 |
| 5 | 0.09 | 0.14 | 2.07 | 0.007 | 0.002 | 0.90 | 0.98 | 0.45 | 0.018 | 0.016 | 0.036 | 0.0034 | Ca:0.005 | 2.67 |
| 6 | 0.05 | 0.16 | 1.79 | 0.014 | 0.001 | 0.92 | 1.16 | 0.47 | 0.029 | 0.018 | 0.032 | 0.0037 | Cr:0.30, V:0.05 | 2.69 |
| 7 | 0.08 | 0.06 | 2.16 | 0.008 | 0.001 | 0.95 | 1.15 | 0.48 | 0.031 | 0.014 | 0.031 | 0.0031 | | 2.83 |
| 8 | 0.09 | 0.35 | 2.18 | 0.007 | 0.001 | 0.96 | 1.12 | 0.47 | 0.019 | 0.018 | 0.036 | 0.0035 | Cr:0.50 | 3.37 |
| 9 | 0.12 | 0.31 | 2.01 | 0.009 | 0.001 | 0.56 | 0.99 | 0.45 | 0.038 | 0.013 | 0.030 | 0.0029 | | 2.61 |
| 10 | 0.07 | 0.09 | 2.80 | 0.006 | 0.002 | 0.60 | 1.02 | 0.42 | 0.030 | 0.016 | 0.037 | 0.0031 | | 3.17 |
| 12 | 0.05 | 0.07 | 1.72 | 0.006 | 0.001 | 0.36 | 0.82 | 0.36 | 0.018 | 0.013 | 0.036 | 0.0029 | | 1.77 |

TABLE 6

| Section | Steel | Plate Thickness (mm) | Tempering | Micro-Structure: Ferrite Fraction (%) | Proportion of Worked Ferrite (%) | Mean Ferrite Grain Size (μm) | Mechanical Properties: YS (MPa) | TS (MPa) | $vE_{-40}$ (J) | vTrs (°C.) | HAZ Toughness $vE_{-20}$ (J) | Field Weldable Lowest Preheating Temperature (°C.) |
|---|---|---|---|---|---|---|---|---|---|---|---|---|
| Steel of This Invention | 1 | 20 | — | 32 | 86 | 3.3 | 725 | 1094 | 246 | −115 | 174 | Preheating Not Necessary |
| | 1 | 20 | 550° C. × 20 mm | 32 | 86 | 3.3 | 793 | 1088 | 239 | −110 | 173 | Preheating Not Necessary |
| | 2 | 16 | — | 42 | 58 | 4.5 | 733 | 1056 | 255 | −100 | 165 | Preheating Not Necessary |
| | 3 | 20 | — | 51 | 76 | 3.9 | 751 | 1093 | 248 | −105 | 137 | Preheating Not Necessary |
| | 4 | 20 | — | 29 | 65 | 4.6 | 748 | 1101 | 263 | −95 | 154 | Preheating Not Necessary |
| | 5 | 20 | — | 43 | 69 | 3.2 | 724 | 1107 | 218 | −95 | 139 | Preheating Not Necessary |
| | 6 | 20 | — | 65 | 83 | 2.5 | 777 | 1133 | 222 | −90 | 156 | Preheating Not Necessary |
| | 7 | 25 | — | 38 | 53 | 4.0 | 735 | 1127 | 225 | −100 | 161 | Preheating Not Necessary |
| | 8 | 25 | — | 81 | 100 | 2.4 | 734 | 1154 | 213 | −85 | 128 | Preheating Not Necessary |
| Comparative Steel | 9 | 20 | — | 29 | 82 | 3.4 | 721 | 1163 | 173 | −70 | 43 | Preheating Not Necessary |
| | 10 | 20 | — | 39 | 74 | 3.6 | 736 | 1172 | 194 | −75 | 61 | −100 |
| | 12 | 20 | — | 75 | 90 | 3.9 | 649 | 872 | 185 | −90 | 34 | Preheating Not Necessary |
| | 1* | 20 | — | 66 | 85 | 7.8 | 705 | 1088 | 199 | −70 | 158 | Preheating Not Necessary |
| | 1* | 20 | — | 16 | 95 | 3.9 | 815 | 1100 | 187 | −70 | 170 | Preheating Not Necessary |
| | 1* | 20 | — | 37 | 30 | 3.8 | 612 | 933 | 170 | −65 | 166 | Preheating Not Necessary |

The steel compositions of Comparative Steel 1* in Table 6 were the same as steel 1 of this invention, but the micro-structure was different.

EFFECT OF THE INVENTION

The present invention can stably mass-produce a steel for an ultra-high strength line pipes (having a tensile strength of at least 950 MPa and exceeding X100 by the API standard) having excellent low temperature toughness and field weldability. As a result, the safety of a pipeline can be remarkably improved, and transportation efficiency as well as execution efficiency of the pipeline can be drastically improved.

We claim:

1. A high strength line pipe steel having a low yield ratio and excellent in low temperature toughness, containing, in terms of percent by weight:

C: 0.05 to 0.10%,

Si: not greater than 0.6%,

Mn: 1.7 to 2.5%,

P: not greater than 0.015%,

S: not greater than 0.003%,

Ni: 0.1 to 1.0%,

Mo: 0.15 to 0.60%,

Nb: 0.01 to 0.10%,

Ti: 0.005 to 0.030%,

Al: not greater than 0.06%,

B: up to 0.0020%,

Cu: up to 1.2%,

Cr: up to 0.8%,

V: up to 0.10%,

N: 0.001 to 0.006%, and the balance of Fe and unavoidable impurities;

having a P value, defined by the following general formula, within the range of 1.9 to 4.0; and having a micro-structure comprising martensite, bainite and ferrite, wherein a ferrite fraction is from 20 to 90%, said ferrite contains 50 to 100% of worked ferrite, and a ferrite mean grain size is not greater than 5 μm;

$P=2.7C+0.4Si+Mn+0.8Cr+0.45(Ni+Cu)+(1+\beta)Mo+V-1+\beta$, with the proviso that β takes a value 0 when B<3 ppm, and a value 1 when B≧3 ppm.

2. A high strength line pipe steel having a low yield ratio and excellent in low temperature toughness, according to claim 1, which further contains:

B: 0.0003 to 0.0020%,

Cu: 0.1 to 1.2%,

Cr: 0.1 to 0.8%, and v: 0.01 to 0.10%.

3. A high strength line pipe steel having a low yield ratio and excellent in low temperature toughness, according to claim 1, which further contains:

Co: 0.001 to 0.006%,

REM: 0.001 to 0.02%, and

Mg: 0.001 to 0.006%.

4. A high strength line pipe steel having a low yield ratio and excellent in low temperature toughness, containing, in terms of percent by weight:

C: 0.05 to 0.10%,

Si: not greater than 0.6%,

Mn: 1.7 to 2.2%,

P: not greater than 0.015%,

S: not greater than 0.003%,

Ni: 0.1 to 1.0%,

Mo: 0.15 to 0.50%,

Nb: 0.01 to 0.10%,

Ti: 0.005 to 0.030%,

Al: not greater than 0.06%,

B: 0.0003 to 0.0020%,

N: 0.001 to 0.006%, and the balance of Fe and unavoidable impurities:

having a P value, defined by the following general formula, within the range of 2.5 to 4.0; and having a micro-structure comprising martensite, bainite and ferrite, wherein a ferrite fraction is 20 to 90%, said ferrite contains 50 to 100% of worked ferrite, and a ferrite mean grain size is not greater than 5 μm;

P value=2.7C+0.4Si+Mn+0.45Ni+2Mo.

5. A high strength line pipe steel having a low yield ratio and excellent in low temperature toughness according to claim 4, which further contains:

V; 0.01 to 0.10%,

Cr: 0:1 to 0.6%, and

Cu: 0.1 to 1.0%.

6. A high strength line pipe steel having a low yield ratio and excellent in low temperature toughness, containing, in terms of percent by weight:

C: 0.05 to 0.10%,

Si: not greater than 0.6%,

Mn: 1.7 to 2.5%,

P: not greater than 0.015%,

S: not greater than 0.003%,

Ni: 0.1 to 1.0%,

Mo: 0.35 to 0.50%,

Nb: 0.01 to 0.10%,

Ti: 0.005 to 0.030%,

Al: not greater than 0.06%,

Cu: 0.8 to 1.2%,

Cr: up to 0.6%,

V: up to 0.10%,

N: 0.001 to 0.006%, and the balance of Fe and unavoidable impurities;

having a P value, defined by the following general formula, within the range of 2.5 to 3.5; and having a micro-structure comprising martensite, bainite and ferrite , wherein a ferrite fraction is from 20 to 90%, said ferrite contains 50 to 100 of worked ferrite, and a ferrite me an grain size is not greater than 5 μm;

P=2.7C+0.4Si+Mn+0.8Cr+0.45(Ni+Cu)+.

7. A high strength line pipe steel having a low yield ratio and excellent in low temperature toughness, according to claim 6, which further contains:

Cr: 0.1 to 0.6%, and v: 0.01 to 0.10%.

8. A high strength line pipe steel having a low yield ratio and excellent in low temperature toughness according to claim 4, which further contains:

Ca: 0.001 to 0.006%,

REM: 0.001 to 0.02%, and

Mg: 0.001 to 0.006%.

9. A high strength line pipe steel having low yield ratio and excellent in low temperature toughness, according to claim 5, which further contains:

Ca: 0.001 to 0.006%,

REM: 0.001 to 0.02%, and

Mg: 0.001 to 0.006%.

10. A high strength line pipe steel having low yield ratio and excellent in low temperature toughness, according to claim 6, which further contains:

Ca: 0.001 to 0.006%,

REM: 0.001 to 0.02%, and

Mg: 0.001 to 0.006%.

11. A high strength line pipe steel having low yield ratio and excellent in low temperature toughness, according to claim 7, which further contains:

Ca: 0.001 to 0.006%,

REM: 0.001 to 0.02%, and

Mg: 0.001 to 0.006%.

12. A high strength line pipe steel having low yield ratio and excellent in low temperature toughness, according to claim 2, which further contains:

Ca: 0.001 to 0.006%,

REM: 0.001 to 0.02%, and

Mg: 0.001 to 0.006%.

* * * * *

UNITED STATES PATENT AND TRADEMARK OFFICE

CERTIFICATE OF CORRRECTION

PATENT NO. : 5,755,895
DATED : May 26. 1998
INVENTOR(S) : Hiroshi Tamehiro, et. al.

It is certified that error appears in the above-identified patent and that said Letters Patent is hereby corrected as shown below:

Title page, item [56], insert the followings:

OTHER DOCUMENTS

| | | |
|---|---|---|
| | | NKK Engineering Report, No. 138 (1992), pp. 24-31. |
| | | |
| | | Proceeding of the 7th International Conference Offshore Mechanics and Arctic |
| | | Engineering, OMAE 1988, Houston. |
| | | |

Signed and Sealed this

Ninth Day of March, 1999

*Attest:*

Q. TODD DICKINSON

*Attesting Officer*

*Acting Commissioner of Patents and Trademarks*

UNITED STATES PATENT AND TRADEMARK OFFICE

CERTIFICATE OF CORRECTION

PATENT NO. : 5,755,895

DATED : May 26, 1998

INVENTOR(S) : Hiroshi TAMEHIRO, et al.

It is certified that error appears in the above-identified patent and that said Letters Patent is hereby corrected as shown below:

On the title page item [57],

ABSTRACT, line 9, change "1000" to --100%--.

ABSTRACT, line 10, change "Am." to --μm.--.

Column 1, line 36, after "technologies" insert a period.

Column 2, line 6, change "values" to --value--.

Column 2, line 67, change "0,10%," to --0.10%,--.

Column 3, line 2, change "Al;" to --Al:--.

Column 3, line 14, change "0.45i" to --0.4Si--.

Column 3, line 14, change "(1B)Mo+v" to --(1+B)Mo+V--.

Column 3, line 23, change "Cr; 0.1 to 0.6%," to --Cr: 0.1 to 0.8%,--.

Column 3, line 36, change "Si;" to --Si:--.

Column 3, line 47, change "B;" to --B:--.

UNITED STATES PATENT AND TRADEMARK OFFICE

CERTIFICATE OF CORRECTION

PATENT NO. : 5,755,895

DATED : May 26, 1998

INVENTOR(S) : Hiroshi TAMEHIRO, et al.

It is certified that error appears in the above-indentified patent and that said Letters Patent is hereby corrected as shown below:

Column 3, line 67, change "0,10%," to --0.10%,--.

Column 4, line 22, change "Mn4" to --Mn+--.

Column 4, line 40, delete the comma after "detail".

Column 5, line 3, change "5 m." to --5μm.--.

Column 5, line 5, change "Chaxpy" to --Charpy--.

Column 5, line 26, change "obtained," to --obtained.--.

Column 5, line 28, change "micro-structure," to --micro-structure.-- and "Hereinafter" should start a new paragraph.

Column 6, line 6, after "high" insert a comma.

Column 6, line 36, change "HAZ When" to --HAZ. When--.

Column 6, line 37, change "0,005%), to --0.005%),--.

Column 7, line 43, change "Nb However" to --Nb. However--

UNITED STATES PATENT AND TRADEMARK OFFICE

CERTIFICATE OF CORRECTION

PATENT NO. : 5,755,895

DATED : May 26, 1998

INVENTOR(S) : Hiroshi TAMEHIRO, et al.

It is certified that error appears in the above-indentified patent and that said Letters Patent is hereby corrected as shown below:

Column 8, line 4, change "weldability," to --weldability.--.

Column 8, line 9, change "(0))" to --(0)]--.

Column 8, line 10, change "5" to --5--.

Column 8, line 17, change "It" to --If--.

Column 8, line 46, change "atructure,.-thereby" to --structure, thereby--.

Column 9, line 29, change "C.," to --C.--.

Column 10, line 18, change "mm-thick)," to --mm-thick).--

Column 10, line 30, change "$vE_{31\ 20}$)" to --$vE._{20}$)--.

Column 12, line 59, change "$vE-_{zo}$)" to --$vE-_{20}$)--.

UNITED STATES PATENT AND TRADEMARK OFFICE

CERTIFICATE OF CORRECTION

PATENT NO. : 5,755,895

DATED : May 26, 1998

INVENTOR(S) : Hiroshi TAMEHIRO, et al.

It is certified that error appears in the above-indentified patent and that said Letters Patent is hereby corrected as shown below:

Column 15, line 9, change "-400 " to ---40 --.

Column 15, line 10, change "video)" to --vE-$_{40}$)--.

Column 15, line 11, change "40 " to --1,400 --.

Column 17, line 2, delete "this" and insert --the present--.

In the Claims:

Column 17, line 54, change "v:" to --V:--.

Column 17, line 58, change "0,006%" to --0.006%--.

Column 17, line 60, change "0,006%" to --0.006%--.

Column 17, line 67, change "1,7" to --1.7--.

Column 18, line 23, change "V;" to --V:--.

Column 18, line 50, change "100" to --100%--.

Column 18, line 51, change "me an" to --mean--.

UNITED STATES PATENT AND TRADEMARK OFFICE

CERTIFICATE OF CORRECTION

PATENT NO. : 5,755,895 Page 5 of 5

DATED : May 26, 1998

INVENTOR(S) : Hiroshi TAMEHIRO, et al.

It is certified that error appears in the above-indentified patent and that said Letters Patent is hereby corrected as shown below:

Column 18, line 53, change "+." to --+Mo+V-1.--.

Column 18, line 58, change "v:0.01 to 0,10% to --V:0.01 to 0.10%--.

Signed and Sealed this

Ninth Day of January, 2001

*Attest:*

Q. TODD DICKINSON

*Attesting Officer*

*Commissioner of Patents and Trademarks*

UNITED STATES PATENT AND TRADEMARK OFFICE

CERTIFICATE OF CORRECTION

PATENT NO. : 5,755,895

DATED : May 26, 1998

INVENTOR(S) : Hiroshi TAMEHIRO, et al.

It is certified that error appears in the above-identified patent and that said Letters Patent is hereby corrected as shown below:

Column 8, line 23, change "AQ" to --A1--.

Signed and Sealed this

Thirteenth Day of March, 2001

*Attest:*

Nicholas P. Godici

NICHOLAS P. GODICI

*Attesting Officer*

*Acting Director of the United States Patent and Trademark Office*